US007500439B2

(12) United States Patent
Collins

(10) Patent No.: US 7,500,439 B2
(45) Date of Patent: Mar. 10, 2009

(54) METHOD AND APPARATUS

(75) Inventor: Patrick Joseph Collins, Ellon (GB)

(73) Assignee: Ythan Environmental Services Ltd. (GB)

( * ) Notice: Subject to any disclaimer, the term of this patent is extended or adjusted under 35 U.S.C. 154(b) by 25 days.

(21) Appl. No.: 11/545,795

(22) Filed: Oct. 10, 2006

(65) Prior Publication Data

US 2007/0289519 A1 Dec. 20, 2007

(51) Int. Cl.
*B63C 1/02* (2006.01)

(52) U.S. Cl. ..... 114/45

(58) Field of Classification Search ..... 114/54, 114/45

See application file for complete search history.

(56) References Cited

U.S. PATENT DOCUMENTS

| | | | | |
|---|---|---|---|---|
| 3,602,177 | A * | 8/1971 | Helbig | 114/54 |
| 3,814,043 | A * | 6/1974 | Krout | 114/54 |
| 3,827,383 | A | 8/1974 | Winer et al. | |
| 4,193,057 | A | 3/1980 | Bennett et al. | |
| 4,737,407 | A | 4/1988 | Wycech | |
| 4,979,451 | A * | 12/1990 | Searle | 114/54 |
| 5,516,235 | A | 5/1996 | Stangroom | |
| 6,409,431 | B1 * | 6/2002 | Lynch | 405/200 |
| 2004/0033905 | A1 | 2/2004 | Shinbach et al. | |

FOREIGN PATENT DOCUMENTS

| | | |
|---|---|---|
| EP | 0 154 521 | 9/1985 |
| GB | 1172032 | 11/1969 |
| GB | 2 377 001 A | 12/2002 |
| GB | 0611868.1 | 9/2006 |
| JP | 63-267528 | 11/1988 |
| WO | WO 94/04865 | 3/1994 |
| WO | WO 97/31975 | 9/1997 |
| WO | WO 01/072416 A1 | 9/2002 |
| WO | WO 2004/087496 A2 | 10/2004 |

* cited by examiner

*Primary Examiner*—Stephen Avila
(74) *Attorney, Agent, or Firm*—Taft Stettinius & Hollister LLP

(57) ABSTRACT

The present invention concerns a buoyant fluid comprising a liquid and a plurality of rigid containers, the rigid containers each having a sealed void containing a gas. A particular use is to transport heavy objects subsea. The gas in the rigid containers provides buoyancy but does not compress at different subsea pressures. Therefore effective buoyancy control subsea is much easier compared to known methods. For certain embodiments, a secured supply container may be provided subsea to supply the liquid and rigid containers to a lifting device having a container therefor and an attachment mechanism secured to the object being transported. The liquid is preferably a biodegradable substance such as vegetable oil.

16 Claims, 2 Drawing Sheets

METHOD AND APPARATUS

CROSS REFERENCE TO RELATED APPLICATIONS

This application claims priority under the applicable provisions of 35 U.S.C. §§119, 120 to, and the benefit of, United Kingdom Patent Application Serial No. 0611868.1, entitled "Method and Apparatus," filed on Jun. 15, 2006.

BACKGROUND OF THE INVENTION

This invention relates to a fluid, method and apparatus for providing buoyancy, particularly for moving heavy objects underwater.

Buoyancy techniques are well known and frequently applied for the movement or retrieval of structures underwater. In general, they comprise a container or bag that is attached to the structure that needs to be moved together with a gas which is used to fill or partially fill the container exerting a buoyant force on the structure allowing it to be lifted.

While this approach is effective in shallow water, it becomes problematic in deeper water. This is because gas being compressible will require to be applied at a pressure exceeding that of hydrostatic pressure in order to provide buoyancy. Furthermore, on moving towards the surface the gas will expand rapidly increasing buoyancy and the rate which the container, together with its tethered structure, rises to the surface accelerates and becomes uncontrollable.

An alternative approach involves the construction of rigid buoyancy elements using syntactic materials which are weighted. These are affixed to the structure and the weights removed by, for instance, a remote operating vehicle from the buoyancy elements. This approach has the disadvantage that once released of their weights, the buoyancy elements exert a sudden upward force which can be difficult to control and could cause damage to subsea equipment, such as ROVs, and personnel.

To tackle this problem, the weight of the structure to be lifted is determined and complex calculations performed so that a suitable amount of buoyancy is provided. However sometimes it is difficult to know the weight of the structure to be lifted and it has been known for calculations to be incorrect, resulting in the dangerous sudden upward movement of the buoyancy elements and attached structure.

Moreover, such buoyancy elements must be returned to the surface when structures of different weights need to be lifted.

SUMMARY OF THE INVENTION

According to a first aspect of the present invention, there is provided a buoyant fluid comprising a liquid and a plurality of rigid containers, the rigid containers each having a sealed void containing a gas.

Preferably the buoyant fluid has a specific gravity of less than 0.78 g/cm$^3$, more preferably less than 0.70 g/cm$^3$, even more preferably less than 0.65 g/cm$^3$, especially less than below 0.60 g/cm$^3$ and more especially less than 0.56 g/cm$^3$.

The rigid containers may be between 5 microns and 5 mm in diameter, preferably between 10 microns and 500 micron in diameter and more preferably between 20 micron and 200 micron in diameter.

"Rigid" in this context means that the rigid containers are incompressible at the pressures found in underwater environments.

Preferably, the rigid containers are microspheres.

The buoyant fluid may comprise a hydrocarbon (preferably low toxicity) such as an aliphatic oil, poly alpha olefin, alkyl ester or vegetable oil that is a triglyceride such as one having the structure:

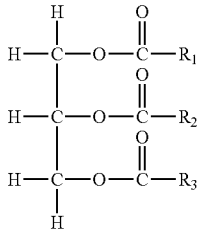

Triglyceride where $R_1$, $R_2$, and $R_3$ are hydrocarbon chains typically with a chain length of between $C_{12}$ and $C_{22}$ to give a range of fatty acids and between zero to three double bonds in the hydrocarbon chain length. Most typically such materials are derived from nature as vegetable oils although synthetic alternatives maybe made.

Thus for certain embodiments of the invention, the inherent environmental risk that some liquid therein may leak is not a significant concern because biodegradable oils may be used, such as vegetable oil, which would not be a concern to wildlife in the unlikely event of a leak.

The liquid may also comprise a viscosifying agent such as organophilic clay, dispersed silica, long chain polymeric materials, surfactants or mixtures of the aforesaid agents.

Preferably the buoyant fluid exhibits viscoelastic and or rheological properties.

At a low shear rate of 0.5 rpm, the viscosity, as measured on a Brookfield type viscometer, of the buoyant fluid can optionally be between 10,000 and 100,000 centipoise, preferably between 20,000 and 100,000 centipose, more preferably between 40,000 and 80,000 centipose.

At a high shear rate of 30 rpm, optionally the viscosity as measured on a Brookfield type viscometer, of the buoyant fluid can be between 500 and 10,000 centipose, preferably between 1,000 and 5,000 centipose, more preferably between 2,000 and 3,000 centipose.

Preferably, the buoyant fluid is an incompressible fluid.

Optionally the buoyant fluid may be used to displace water in subsea structures thereby generating a buoyant force.

The buoyant fluid can be pumped into vessels, structures, or bags rendering them buoyant or partially buoyant. This can be done prior to installation of subsea components, during installation of subsea structures or as part of a process of recovery of subsea structures.

According to a second aspect of the present invention, there is provided a method of controlling the buoyancy of a structure, the method comprising, in any order:

(a) injecting or removing a buoyant fluid into or from a first container, said first container connected to or integral with said structure;

(b) immersing the container in an immersion fluid;

said buoyant fluid comprising a liquid and said buoyant fluid having a density which is less than the density of the immersion fluid.

Preferably the buoyant fluid comprises a plurality of rigid containers, the rigid containers each having a sealed void containing a gas.

Thus preferably the buoyant fluid according to the second aspect of the invention is the buoyant fluid according to the first aspect of the invention.

According to a third aspect of the invention, there is provided a method of controlling the buoyancy of a structure, the method comprising, in any order:

(a) injecting or removing a buoyant fluid into or from a first container, said first container connected to or integral with said structure;

(b) immersing the container in an immersion fluid;

said buoyant fluid comprising a liquid and a plurality of rigid containers, the rigid containers each having a sealed void containing a gas;

and said buoyant fluid having a density which is less than the density of the immersion fluid.

Typically the immersion fluid is water, especially sea water.

The buoyant fluid may also be added to or removed from the first container before it is immersed in the immersion fluid.

Preferably the buoyant fluid substantially comprises liquid, as well as any rigid containers.

The gas in each rigid container may be air, nitrogen, argon or another gas sufficient to achieve a low bulk density.

Preferably, the buoyant fluid is an incompressible fluid.

An advantage of embodiments of the present invention is that the incompressible fluid does not undergo a volume change when the depth and therefore the pressure of the first container is varied. Consequently, the first container of embodiments of the present invention will not accelerate as its depth varies and so greater control of the structure is afforded.

According to a fourth aspect of the present invention, there is provided an apparatus to control the buoyancy of a structure, the apparatus comprising:

a first container having a first void suitable for receiving a buoyant fluid, said first container connectable to, or integral with, said structure;

an aperture in the first container, adapted to allow injection and removal of said buoyant fluid into and out of the first container.

According to a fifth aspect of the invention, there is provided an apparatus to control the buoyancy of a structure, the apparatus comprising:

a first container having a first void suitable for receiving a buoyant fluid, said first container connectable to, or integral with, said structure;

an aperture in the first container, adapted to allow injection and removal of said buoyant fluid into and out of the first container;

wherein said buoyant fluid comprises a liquid and a plurality of rigid containers, the rigid containers each having a sealed void containing a gas.

Preferably, said first void is defined within a bladder. Preferably, a second void is defined between the bladder and the first container. Preferably, a first valve is provided to communicate with the first void. Preferably the first valve is arranged at said aperture to allow injection or removal of the buoyant fluid into and out of the first container.

Preferably, a second valve is provided to communicate with the second void. The bladder is preferably flexible so that the volume of the first and second voids can vary although the sum of their volumes typically remains constant.

The apparatus may comprise a supply container which, in use, contains a buoyant fluid. Preferably the buoyant fluid is the buoyant fluid described herein with respect to earlier aspects of the invention.

In use, the supply container is typically connected to the first container via a line (preferably flexible), the line suitable to transfer buoyant fluid between the first container and the supply container.

Preferably, the supply container comprises a first void, defined within a bladder and a second void defined between the bladder and the container.

Preferably, the supply container comprises a first valve to communicate with its first void and preferably also a second valve to communicate with its second void.

Preferably, the bladder is flexible so that the volume of the first and second void can vary, although the sum of their volumes is typically constant.

Alternatively, the first container may receive the buoyant fluid from a surface vessel, such as a ship or oil rig, or any other suitable source.

Where utilized, preferably the supply container comprises a stabilizing means, such as weights, or a line, in order to maintain a generally constant depth during use regardless of the amount of incompressible fluid within the supply container at any one time.

A portion of the buoyant fluid may be added to the first container onshore and the container then immersed in water.

Preferably, the apparatus comprises a pump to transfer the buoyant fluid between the supply container (or other source) and the first container.

Preferably all the valves are proportional valves rather than on/off valves, especially the valves in communication with the first voids. Thus accurate control of the proportion of buoyant fluid present in the first container at any one time is provided.

To move the buoyant fluid between the first container and other source, preferably the pressure in the container or source which is to reduce its buoyant fluid content is increased.

To move the buoyant fluid from the supply container to the first container, water may be injected into the second void of the supply container to compress the bladder and increase the pressure in the supply container, thus forcing the buoyant fluid out of the first void of the supply container and into the first void of the first container. Once sufficient buoyant fluid has been transferred from the supply container to the first container, the structure will become buoyant. It can then be moved and positioned as required.

To remove the buoyancy of the structure, the buoyant fluid may be removed from the first container. To remove the buoyant fluid from the first container, water may be pumped into the second void of the first container to compress the bladder of the first container thus causing the buoyant fluid to move via the line into the supply container, thus reducing the buoyancy of the first container.

The invention also allows a structure to be filled with buoyant fluid, attached to the first container and the buoyant fluid gradually removed from the first container in order to allow a controlled launch of the structure to the seabed or subsea installation.

Thus embodiments of the present invention provide more control because the buoyant fluid can be added or removed from the container in situ, that is when it is immersed in the water or other immersion fluid.

According to a sixth aspect of the present invention, there is provided a method of controlling the buoyancy of a structure, the method comprising:

(a) immersing a first container in an immersion fluid, said first container connected to or integral with said structure; then, (b) injecting or removing a buoyancy fluid into or from the first container;

said buoyancy fluid having a density which is less than the density of the immersion fluid.

Preferably the sixth aspect of the present invention is performed with the method, apparatus and buoyant liquid according to earlier aspects of the invention.

The buoyant fluid may consist of or comprise air, but preferably comprises liquid.

Any feature of any aspect of any invention or embodiment described herein may be combined with any feature of any aspect of any other invention or embodiment described herein *mutatis mutandis*.

BRIEF DESCRIPTION OF THE DRAWINGS

An embodiment of the present invention will now be described, by way of example only, with reference to the accompanying figure, in which.

DESCRIPTION OF THE PREFERRED EMBODIMENTS

Figure 1:
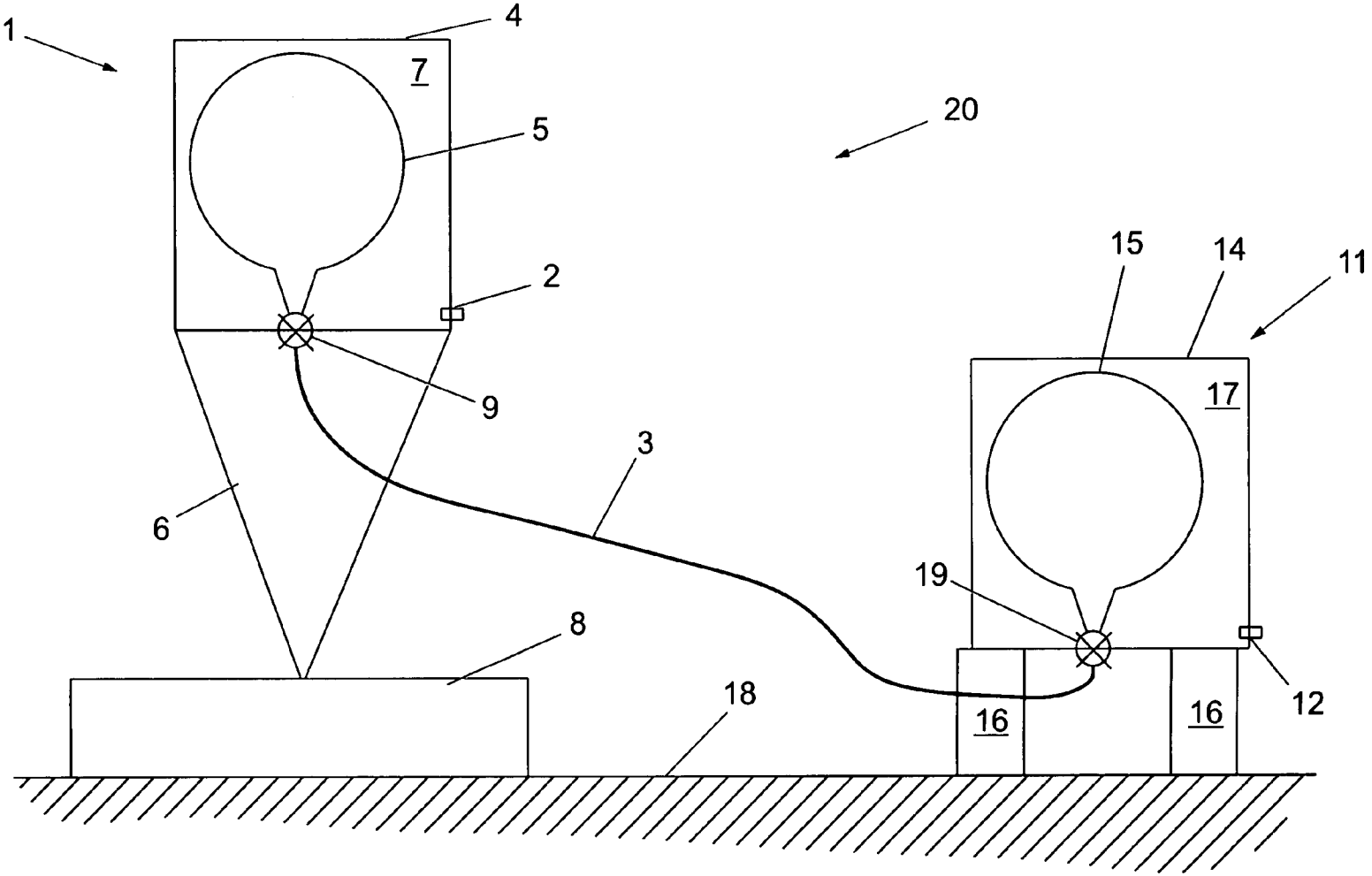
FIG. 1 is a diagrammatic view of an apparatus in accordance with one aspect of the present invention; and, FIG. 2 is a diagram showing the viscosity against shear rate for a buoyant fluid in accordance with one aspect of the present invention.

FIG. 1 shows an apparatus 20 comprising a buoyancy device 1 and a supply unit 11. The apparatus 20 may be used to move an object, such as an object 8, from one subsea location to another (or even to or from the surface.) This can be useful for constructing oil well assemblies, laying pipelines, recovering submerged objects, or any other reason for moving objects underwater.

The buoyancy device 1 is attached, via cables or shackles 6, to the object 8 on sea bed 18, and via a hollow umbilical line 3, to the supply unit 11. Buoyant fluid can be transported between the buoyancy device 1 and supply unit 11 via the umbilical 3, as described further below.

The buoyancy device 1 comprises a rigid housing 4. Inside the housing 4 is a bag or bladder 5 manufactured from a strong impermeable material such as rubber, polypropylene or reinforced fabric or material. In use, the bag 5 contains a certain amount of buoyant fluid, described further below. A space 7 is defined between the bag 5 and the inside of the housing 4. The inside of the bag 5 is in fluid communication with the umbilical 3, via a proportional valve 9.

In alternative embodiments, the housing 4 may not be a rigid structure but may be a bag or bladder manufactured from a strong impermeable material such as rubber, polypropylene or reinforced fabric or material.

A further valve 2 is provided on the outside of the housing 4 to allow water from outside the housing 1 to enter and exit the space 7 between the bag 5 and the inside of the housing 4.

The supply unit 11 takes on a similar configuration: a bag 15 is provided within a rigid housing 14 and the inside of the bag 15 is in fluid communication with the umbilical 3 via a proportional valve 19. A space 17 is defined between the bag 15 and the inside of the housing 4. The supply unit 11 comprises a further valve 12 on the housing 14 to allow water to enter and exit the space 17 between the bag 15 and the inside of the housing 14.

The supply unit 11 also has weights 16 which cause it to sink and rest on the seabed 18. Buoyant fluid is stored in the bag 15, but regardless of the amount of buoyant fluid, the supply unit 11 will remain on the seabed 18 during use.

A pump (not shown) is attachable to the valves 2, 12 in order to pump sea water from the surroundings into the spaces 7, 17 between the bags 5, 15 and the housings 4, 14 respectively.

Inside the bags 5, 15 is the buoyant fluid comprising oil, a viscosifying agent and microspheres. The oil is preferably a low toxicity oil such as a vegetable oil. The viscosifying agent may be organophilic clay for example. The addition of the viscosifying agent gives the buoyant fluid viscoelastic rheological properties. Since the fluid is viscoelastic it can be pumped easily but when the fluid is at rest the increased viscosity keeps the microspheres in place ensuring a consistent material.

Figure 2:
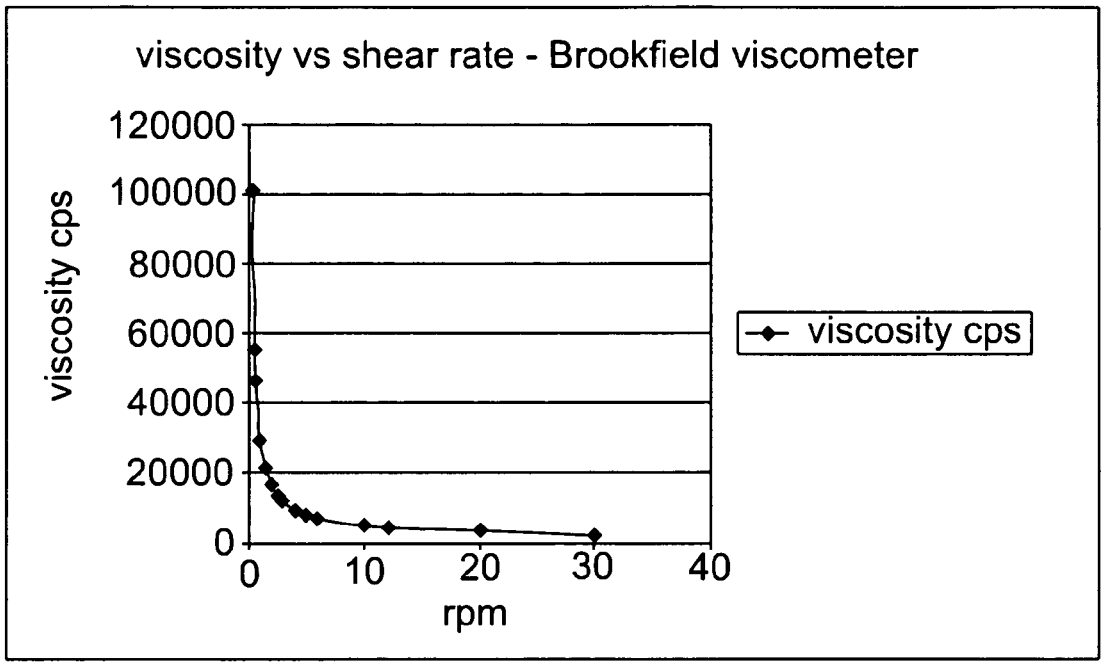

The viscosity of a sample was measured, as defined in ISO 2555, using a Haake ViscoTester 7L at 23 C. using an L3 spindle. Viscosity measurements are in centipoise. The results are shown in table 1 below and in FIG. 2.

TABLE 1

| rpm | viscosity cps |
|---|---|
| 0.3 | 100560 |
| 0.5 | 55330 |
| 0.6 | 46045 |
| 1 | 29530 |
| 1.5 | 21360 |
| 2 | 16610 |
| 2.5 | 13830 |
| 3 | 11800 |
| 4 | 9350 |
| 5 | 7820 |
| 6 | 6690 |
| 10 | 4580 |
| 12 | 4030 |
| 20 | 2825 |
| 30 | 2220 |

Thus the table and graph show that the mixture has viscoelastic properties, that is, at low shear rates the mixture is very viscous. As the shear rate increases, the viscosity decreases. This is an important benefit of certain embodiments of the invention because the high viscosity at low shear rates allows microspheres to be generally evenly distributed within the body of the liquid, rather than rise to the top where they could cause an imbalance in the liquid. The lower viscosity at higher shear rates facilitates the pumping of the fluid into the buoyancy device 1 and supply unit 11 during set up.

The microspheres are small glass spheres with a hollow centre containing air or another gas. Since they contain air, they are relatively very buoyant compared to any type of liquid. Since the air is trapped inside the glass microspheres, the microspheres and the buoyant fluid as a whole are incompressible. The wall thickness of the microspheres may be varied but must be sufficient to withstand the hydrostatic pressure experienced in the depth of water or other liquid in which the apparatus 20 will operate.

The microspheres significantly contribute to the buoyancy of the buoyant fluid within the bags 5, 15. The microspheres are held within the buoyant fluid as a direct consequence of the fluid's viscosity. Thus the individual microspheres will not have sufficient buoyancy to move to the top of the (viscous) buoyant fluid but rather, they will remain in the body of the fluid. This allows the microspheres to mix with the buoyant fluid properly, rather than gather at the surface of the buoyant fluid. This in turn provides a more even balance to the buoyancy of the buoyancy device 1.

Suitable microspheres may be obtained from 3M corporation based in St. Paul, Minn. USA.

For certain embodiments of the invention, the microspheres can act to viscosity the fluid and so the addition of a further viscosifying agents is not necessary. In one example, a buoyant fluid was prepared in the following manner: 60 g of vegetable oil were placed in a beaker to which was added 40 g of S38 glass microspheres from 3M corporation and the mixture was stirred gently to form a fluid viscous mixture with the appearance and consistency of thick cream. To this mixture was added between 0.5 to 1.0 milliliter of water whereupon, surprisingly, the fluid viscosified to form a fluid which at low shear rates exhibits very high viscosity whereas at higher shear rates the viscosity is reduced and the mixture will flow such fluids are described as being viscoelastic. At this point the density of the material was measured and determined to be 0.588 g/cm3.

The viscosity of a sample was measured, as defined in ISO 2555, using a Haake ViscoTester 7L at 21.2 C. Viscosity measurements are in milliPascal seconds. The results are shown in table 2 below.

TABLE 2

| rpm | Spindle | Viscosity (mPas) |
|---|---|---|
| 1 | L3 | 81,760 |
| 1.5 | L3 | 51,270 |
| 2 | L3 | 42,580 |
| 2.5 | L3 | 32,030 |
| 3 | L3 | 28,340 |
| 4 | L3 | 12,030 |
| 5 | L3 | 8,960 |
| 6 | L3 | 8,250 |
| 10 | L3 | 5,500 |
| 20 | L4 | 5,330 |
| 30 | L4 | 4,420 |
| 50 | L4 | 3,880 |
| 60 | L4 | 3,630 |
| 100 | L4 | 3,390 |

Thus the table shows that the mixture has viscoelastic properties, that is, at low shear rates the mixture is very viscous while as the shear rate increases, the viscosity decreases.

Although inclusion of the microspheres is preferred, certain embodiments of the invention do not require microspheres. Instead a buoyant fluid with a density less than water may be used. The relatively reduced density will provide buoyancy. Many buoyant fluids may be used, including for example diesel or methanol.

Thus to operate the apparatus 20, the buoyancy device 1 and supply unit 11 are lowered to the vicinity of the object 8 to be moved. The buoyancy device 1 is attached to the object 8 via the cables 6. A remotely operated vehicle (ROV) may be utilized to attach the cables 6. The buoyancy device 1 will be assumed to have sufficient buoyancy at this stage to support itself, but if not its buoyancy can be increased in the same way as that described below for raising the object 8.

To increase the buoyancy of the buoyancy device 1 and attached object 8, the pump (not shown) is attached to the valve 12 of the supply unit 11 and is activated causing water to be gradually injected into the housing 14 of the supply unit 11 in the space 17 between the bag 15 and the outside of the housing 14 causing an increased pressure within the supply unit 11. Valve 19 in the supply unit 11 and valve 9 in the buoyancy device 1 are opened to allow the buoyant fluid, which is being forced out of the bag 15 in the supply unit 14 by the increased pressure, to travel through the umbilical 3 to the bag 5 in the buoyancy device 1. The valve 2 in the buoyancy device 1 is also opened. Water in the buoyancy device 1 in the space 7 between the bag 5 and the inside of the housing 4 can escape through the opened valve 2.

The buoyancy of the buoyancy device 1 is thus gradually increased by the gradual addition of buoyant fluid until it is of a sufficient magnitude to lift the object 8. The amount of lift or buoyancy imparted is directly proportional to the volume of buoyant fluid pumped into the buoyancy device 1.

Once the object 8 is raised from the seabed 18, the pump attached to the valve 12 can be stopped and the valves 9, 19 are closed to prevent further variation of buoyancy of the buoyancy device 1. Valve 2 is also closed.

Unlike certain known systems, the decrease in depth of the buoyancy device 1 does not result in an increased volume of air and therefore a further increased buoyancy (which would cause upward acceleration of the device and attached object to the surface.)

Also, the change in buoyancy of the buoyancy device is gradual, rather than sudden as is the situation with a further known technique of removing weights from a buoyancy device.

Thus embodiments of the invention are more controllable and provide a safer means of raising immersed objects.

Referring back to the procedure for moving the object 8, the ROV can then move the buoyancy device 1 and object to the appropriate place, relying on the buoyancy device 1 to provide the lift.

To remove the buoyancy from the buoyancy device 1, the opposite procedure is followed. A pump is attached to the valve 2 and pumps water into the space 7 between the bag 5 and the inside of the housing 4. The valves 9, 19, as well as the valve 12 on the supply unit 11, are opened. The buoyant fluid is thus forced by the increased pressure in the buoyancy device through the umbilical 3. The buoyant fluid proceeds to the bag 15 within the supply unit 11. Water in the supply unit 11 in the space 17 between the bag 15 and the inside of the housing 14 can escape through the opened valve 12.

The reduction in the amount of buoyant fluid within the buoyancy device 1 continues until it loses sufficient buoyancy and lowers the attached object 8 onto the seabed 18.

In alternative embodiments, there is no supply unit 11 and the buoyant fluid supplied to the buoyancy device by a line extending to a surface vessel or rig for example.

In an alternative use, the object could be removed from or placed onto another subsea object rather than the seabed.

Thus the buoyant fluid can provide sufficient buoyancy in a controlled manner to render a subsea element buoyant allowing it to be lifted by a remote operating vehicle or submarine and maneuvered into the desired position or recovered to the surface from a great depth. Once in place the buoyant fluid can be removed allowing the subsea element to be secured on the sea bed. This technique can also be employed to lift items from the sea bed to the surface in a controlled manner.

Similarly, structures can be fabricated on shore filled with buoyant fluid, towed out and placed on the sea bed by pumping out the buoyant fluid such that the structure can be lowered into place.

An advantage of certain embodiments of the invention is that since the mixtures are incompressible fluids, buoyancy elements can be constructed of lightweight simple containers which can then filled with the buoyant fluid.

Improvements and modifications may be made without departing from the scope of the invention.

What is claimed is:

1. A method of controlling the buoyancy of a repositionable structure with a buoyant fluid, the buoyant fluid comprising a liquid and a plurality of rigid containers, the rigid containers each having a sealed void containing a gas, the method comprising:

(a) injecting the buoyant fluid in a first direction into a first container, wherein the first container is connected to or integral with the repositionable structure to manipulate an overall buoyancy of the repositionable structure;

(b) immersing the first container in an immersion fluid, wherein the buoyant fluid has a lower density than the immersion fluid;

(c) maintaining the buoyant fluid within the first container as a fluid;

(d) removing at least a portion of the buoyant fluid from the first container in a second direction, the second direction opposite the first direction, to decrease the overall buoyancy and therefore lower the repositionable structure when the repositionable structure is at least partially immersed in the immersion fluid;

wherein acts (a) and (b) may be performed in either order or simultaneously.

2. The method of claim 1, wherein the buoyant fluid exhibits viscoelastic properties, at a low shear rate of 0.5 rpm, the viscosity of the buoyant fluid is between 40,000 and 100,000 centipoise and at a high shear rate of 30 rpm, the viscosity of the buoyant fluid is between 500 and 10,000 centipoise, and wherein the viscosity of the buoyant fluid is as measured on a Brookfield type viscometer.

3. The method of claim 2, wherein the buoyant fluid is an incompressible fluid.

4. The method of claim 2, wherein the buoyant fluid substantially consists of liquid and said rigid containers.

5. The method of claim 2, wherein the buoyant fluid has a specific gravity of less than 0.60 g/cm $^3$ .

6. The method of claim 2, wherein the rigid containers are between 20 microns and 200 microns in diameter.

7. The method of claim 2, wherein the buoyant fluid exhibits rheological properties.

8. The method of claim 2, wherein the buoyant fluid comprises hydrocarbons such as vegetable oil.

9. The method of claim 2, wherein at a low shear rate of 0.5 rpm, the viscosity of the buoyant fluid is between 40,000 and 100,000 centipoise and at a high shear rate of 30 rpm, the viscosity of the buoyant fluid is between 2,000 and 3;000 centipoise.

10. A method as claimed in claim 1, wherein The immersion fluid is water.

11. A method as claimed in claim 1, wherein a supply container is provided with a bladder containing a reservoir of buoyant fluid, the supply container also including a void between the bladder and a housing of the supply container, wherein the supply container is connected to the first container via a line, the line suitable to transfer the buoyant fluid between the first container and the supply container.

12. A method as claimed in claim 11, wherein movement of the buoyant fluid from the supply container to the first container is effected by injection of a fluid into the void of the supply container to compress the bladder and increase the pressure in the supply container, causing the buoyant fluid to move from within the bladder of the supply container into the, first container.

13. The method of claim 1, wherein:

the first container includes two separate chambers;

at least a portion of the immersion fluid occupies a first of the two separate chambers; and the buoyant fluid within the first container is housed with a second of the two separate chambers.

14. The method of claim 1, wherein the buoyant fluid is supplied to the first container by a line extending from at least one of a surface vessel and a rig.

15. A method of transporting objects underwater, the method comprising:

(a) mounting a transport container to a sunken transportable object, the transport container having a transport bladder to contain a viscoelastic buoyant fluid;

(b) pumping seawater into a reservoir container to create a pressure differential across a reservoir bladder housed within the reservoir container, the reservoir bladder containing a viscoelastic buoyant fluid, wherein the pressure differential across the reservoir bladder results in conveyance of at least a portion of the viscoelastic buoyant fluid from the reservoir bladder and into a supply line in communication with an interior of the transport bladder housed within the transport container;, and (c) conveying at least a portion of the viscoelastic buoyant fluid within the supply line into the interior of the transport bladder to increase the buoyancy of the sunken transportable object.

16. The method of claim 15, further comprising:

(d) transporting the sunken transportable object from a first location to a second location; and (e) pumping seawater into the transport container to create a pressure differential across the transport bladder, wherein the pressure differential across the transport bladder results in conveyance of at least a portion of the viscoelastic buoyant fluid from the transport bladder to decrease the buoyancy of the sunken transportable object.

* * * * *